United States Patent [19]

Hanson

[11] 3,971,158

[45] July 27, 1976

[54] ILLUMINATED TWIRLING TOY

[76] Inventor: Cameron G. Hanson, Osceola, Wis. 54020

[22] Filed: Sept. 4, 1974

[21] Appl. No.: 503,140

[52] U.S. Cl. ..... 46/228; 46/65; 240/10.68

[51] Int. Cl.[2] ..... A63H 1/24

[58] Field of Search ..... 46/228, 64, 65; 240/10.68

[56] References Cited

UNITED STATES PATENTS

| | | | |
|---|---|---|---|
| 2,744,189 | 5/1956 | Wudyka | 46/228 |
| 3,226,880 | 1/1966 | Novello | 46/228 |
| 3,325,940 | 6/1967 | Davis | 46/228 |
| 3,528,659 | 9/1970 | Benham | 46/228 |
| 3,531,892 | 10/1970 | Pearce | 46/228 |

FOREIGN PATENTS OR APPLICATIONS

| | | | |
|---|---|---|---|
| 936,349 | 9/1963 | United Kingdom | 46/228 X |

*Primary Examiner*—Louis G. Mancene
*Assistant Examiner*—Robert F. Cutting
*Attorney, Agent, or Firm*—John C. Barnes

[57] ABSTRACT

A toy having an illuminating module wherein a battery, spring and lamp are supported such that the battery will move by centrifugal force against the spring bias toward the lamp and close a circuit between the terminal of the lamp and the battery pole piece and the lamp base through the spring to the end wall of the battery. The toy is provided with a receptacle for the module to position the module in a direction normal to or radial to the axis of circular movement of the toy during its operation.

9 Claims, 10 Drawing Figures

ILLUMINATED TWIRLING TOY

BACKGROUND OF THE INVENTION

This invention relates to an improvement in illuminated toys and particularly in illuminated toys which are illuminated only when a portion of the toy is rotated. The toy does not have any switch to operate the illuminating device and except for centrifugal force applied to the battery there is no operative force available.

DESCRIPTION OF THE PRIOR ART

The prior art is replete with toy constructions and illuminated toys. Some of the illuminated toys are formed with illuminating devices which are activated by a switch which may be energized upon operation of the toy, by hand, or by the position of the toy. Other toy constructions are provided with switching devices which are operative upon a predetermined centrifugal force being applied to the toy and upon the switch. Examples of these toys are shown in U.S. Pat. No. 3,325,940, wherein the toy is provided with a switch including a weight which closes the switch upon centrifugal force being applied to the weight. U.S. Pat. No. 3,528,659 discloses a toy construction wherein a portion of the toy is adapted to be whirled or rotated and in the end of the toy is disposed a conductive metal container in the form of a flashlight barrel having at one end a threaded opening to receive an incandescent lamp and which is provided with a battery spring-biased toward the lamp but separated therefrom by a soft flexible material such as a foam plastic. The soft flexible material separates the post of the battery from the terminal end of the incandescent lamp such that until the toy is subjected to centrifugal force sufficient to overcome the resilience of the flexible material the lamp will not light. As the toy is rotated centrifugal force will cause the battery to move so as to compress the foam and contact the incandescent lamp to light the lamp. This metal container with the threaded end, the spring, the foam washer, the battery and the lamp provides a rather expensive construction for a toy. The metal container may also be readily subjected to damage due to bending which makes the exchange of batteries in the illuminating module more difficult and soon the operation of the toy is destroyed.

It is an object of the present invention to reduce the cost and complexity of the illuminating module for the toy by providing the module from materials which cannot be easily damaged to interfere with their useful life.

It is a further object of the present invention to provide a module which is useable with a variety of toys.

It is a further object of the present invention to provide novel illuminated toys which are illuminated upon operation thereof in a whirling pattern.

BRIEF SUMMARY OF THE INVENTION

The present invention comprises a toy which in operation assumes a circular motion providing a variation in velocity at points along its body. The toy comprises a structure having a receptacle adapted to receive a module for illuminating the toy. The module comprises a cylindrical battery such as used in a pen light and which may have various sizes according to the standard designation. A helical spring of conductive material which will engage the wall of the battery about the end surrounding the pole piece thereof. The module further comprises a small incandescent lamp as used in a flashlight and comprising a base, bulb and a terminal end. The lamp is positioned such that the base is in contact with the spring and the terminal end thereof is positioned in a spaced aligned relationship to the pole piece of the battery. The spring has a normal length sufficient to maintain the terminal end of the lamp spaced from the pole piece and the bulb is spaced toward the edge of the toy or rotating portion which has the greatest velocity such that centrifugal force on the battery will drive it toward the bulb to illuminate the bulb. The module may also comprise a housing formed of insulative material, preferably a polymeric material and may have an end cap or securing means for securing the lamp, spring and battery in the housing.

The toy may comprise a receptacle for receiving and securely holding the module. Likewise the module and the toy receptacle may cooperate to secure the module in place in the proper orientation of the toy. The toy may comprise a saucer-shaped member wherein the receptacle extends radial of the body. The toy may comprise a receptacle which is held in one hand and the module may be secured by a string extending through the receptacle to a loop which may be held in the finger of the other hand of the operator such that the module and its housing may be whirled.

The toy may further be a baton with the module positioned in one end, or the toy may be a bicycle with the receptacle adapted to be secured to the spokes of the bicycle. May toy variations are envisioned with the illuminating module of the present invention such as tops, tether balls, foot hoops, twirl toys, etc.

DESCRIPTION OF THE DRAWING

The invention will be more clearly understood after reading the following description which refers to the accompanying drawing wherein.

DETAILED DESCRIPTION OF THE PREFERRED EMBODIMENTS

The present invention comprises a toy which is adapted to be illuminated. Illumination of the toy is provided by an incandescent bulb which is energized by a small dry cell battery and the circuit is completed by centrifugal force upon a spring which engages the base of the lamp and the wall of the battery such that when the spring is compressed to move the center pole piece of the battery in contact with the terminal end of the lamp the lamp will be illuminated. The circuit, the switch and every thing necessary for lamp illumination is thus provided by three simple parts. These parts form a module for the toy. Assembled the module may also include a housing which housing may be secured by cooperating fastening elements to the toy. The receptacle on the toy for the module should be positioned normal to an outer edge when the toy is being moved through its arc during the operation or play of the toy.

Figure 1:
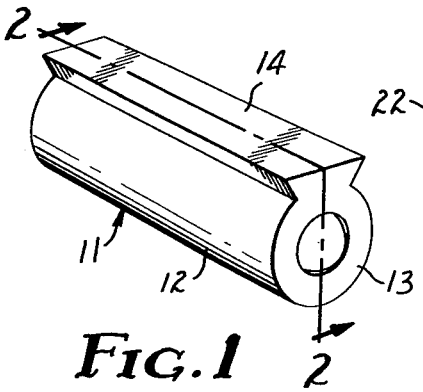
FIG. 1 is a perspective view of one form of module according to the present invention.
Figure 2:
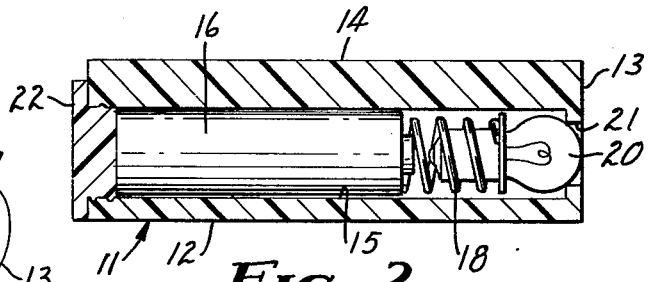
FIG. 2 is a vertical sectional view of the module of FIG. 1.

In FIG. 1 there is shown a module generally designated 11 which includes a body or housing 12 formed with an elongated cylindrical portion 13 joined to an axially extending dove-tailed portion 14 on the edge thereof having beveled side walls to form a retaining means. The housing 12 is provided with a central bore 15 adapted to receive a battery 16, a helical compression spring 18, of conductive material and an incandescent lamp 20. An opening 21 is provided in the end wall of the bore at one end of the housing and a cap 22 is fitted in the opposite end of the bore 15. The cap will retain the lamp 20, spring 18, and battery 16 within the bore. The lamp 20 will preferably comprise a base, a bulb, and a terminal end. The spring 18 receives the base in sliding engagement and engages a flange on the base and the wall of the battery 16 which is one terminal of the battery.

The housing 12 may be formed of a polymeric material which may be opaque or translucent. The housing may be a polyvinyl chloride, polyethylene, polypropylene, polyvinyl alcohol, or other suitable plastic.

Figure 3:
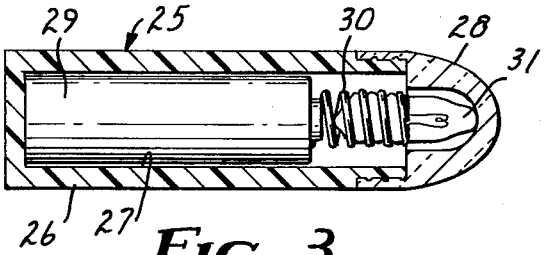
FIG. 3 is a vertical sectional view of a modified form of module.

Referring to FIG. 3 there is illustrated a module 25 comprising a housing formed by a barrel 26 which may be formed of an opaque polymeric material having a bore 27 closed by a cap 28 formed of a translucent or transparent material. Inside of the bore and retained by the cap is a battery 29, a helical compression spring 30 and an incandescent lamp 31.

In this module the spring is wound such that it will receive and engage the threaded base of the lamp and the edge wall of the battery to make electrical contact with the base of the lamp and the battery casing. The spring may be wound counterclockwise to threadably engage the thread on the base of the lamp to retain the spring 30 thereon.

The batteries 16 or 29 may be 1.1 volt to 1.5 volt batteries and have a size from AAA to size N. Ray-O-Vac Division of ESP Incorporated of Madison, Wisconsin 53703, U.S.A., produces a size N battery No. 716, of 1.5 volts which is approximately 1 inch long, however a suitable battery may be number 912, sold under the "Eveready" trademark by Union Carbide Corporation, New York, N.Y. 10017, and designated as size AAA.

Other known sizes of batteries such as the AA or normal pen like batteries may be suitable sources of electromotive force.

The incandescent lamp may be of the common flashlight variety of which there are various forms, some having threaded bases and others having cylindrical bases with a radially extending flange. Various forms of bulbs may be adapted to various structures.

Figure 4:
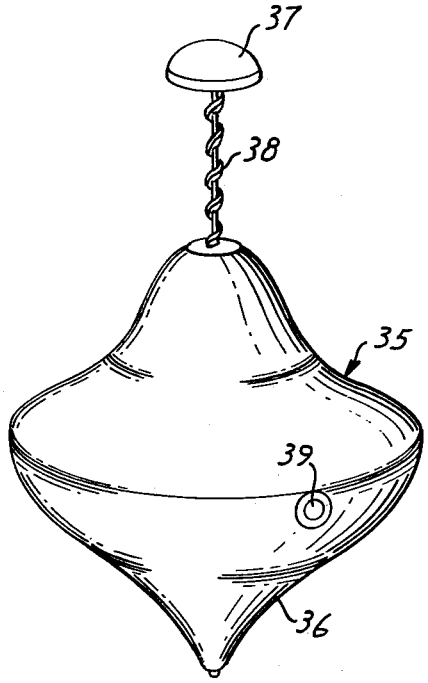
FIG. 4 is a perspective view of a top.

FIG. 4 illustrates a top 35 having a body 36 and an operating handle 37 joined to the top by the helical stem 38. The body 36 may be formed with a radially extending receptacle 39 to receive a module corresponding to that shown in FIG. 3.

Figure 5:
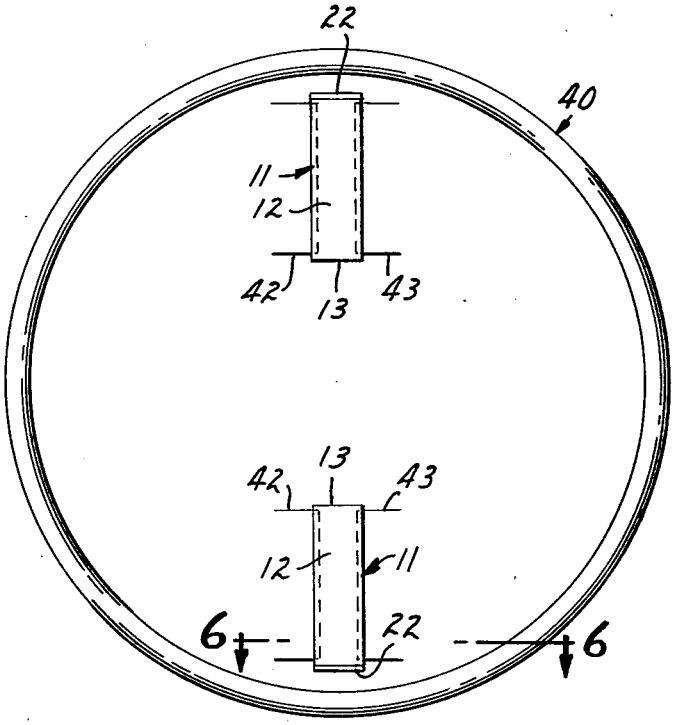
FIG. 5 is a bottom view of a saucer toy.
Figure 6:
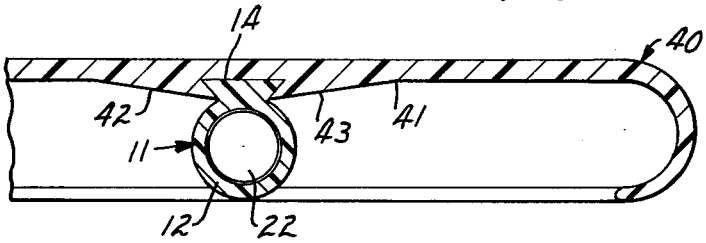
FIG. 6 is a fragmentary sectional view taken approximately along lines 6—6 of FIG. 5.

The whirling saucer toy is illustrated in FIG. 5 and comprises a circular body 40 having a smooth circular top and rolled edges which permit the toy to be grasped by the fingers and thrown, during which throwing the saucer rotates about its axis. The undersurface 41 of the toy is formed with retaining means for a module such as illustrated in FIG. 1. The retaining means may comprise depending fingers 42 and 43 which form recesses to receive the axially extending portion 14 of the housing 12 with its beveled edges engaging the fingers 42 and 43. The module 11 would be placed within the receptacle with the lamp 20 positioned near the peripheral edge of the toy. The toy could be formed of translucent material such that the toy would be illuminated as it is twirling through the air.

Figure 7:
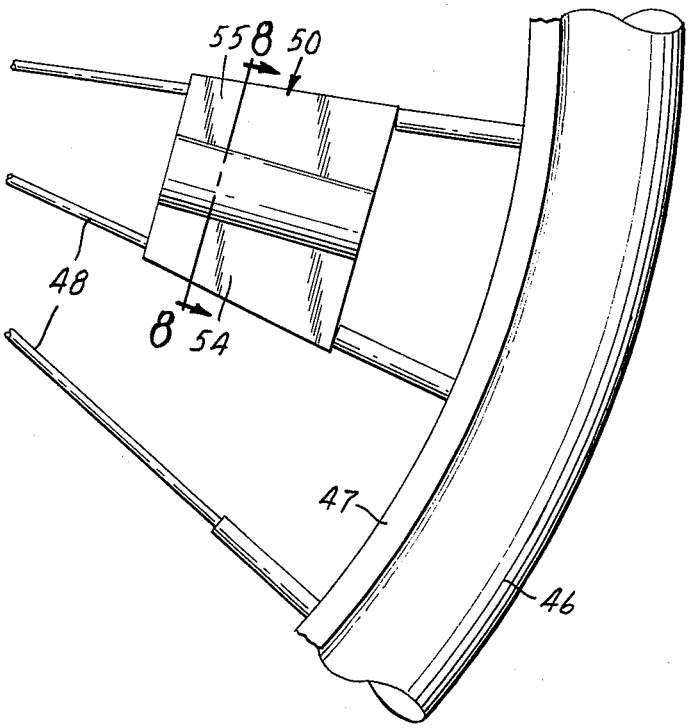
FIG. 7 is a fragmentary view of a bicycle wheel in elevation incorporating the present invention.
Figure 8:
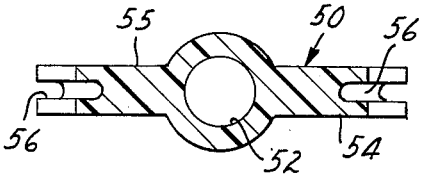
FIG. 8 is an end view of the receptacle shown in FIG. 7.

A bicycle may be illuminated with the module of the present invention and a bicycle wheel and tire 46 are illustrated in FIG. 7 with the rim 47 and spokes 48 being illustrated. A receptacle may be formed to be secured to the spokes of the bicycle near the rim 47. The receptacle is generally illustrated by the reference numeral 50 and comprises a polymeric moulded body being formed with a cylindrical central portion 51 extending the length thereof and having a central bore 52. The center cylindrical portion has outwardly extending ribs 54 and 55 which are each formed with a slot 56. The slots 56 are shaped to receive the adjacent bicycle spokes 48 to retain the receptacle 50 thereon. The bore 52 is adapted to slidably receive the module comprising a battery, a helically wound compression spring and an incandescent lamp. The same may be secured in the bore 52 by means of end caps. Additionally, the bore 52 may be adapted to receive a module such as indicated in FIG. 3. Rotation of the wheel 46 will then produce centrifugal force to drive the battery toward the rim 47 engaging the post with the terminal end of the lamp lighting the same and causing a streak of light as the wheel is rotated.

Figure 9:
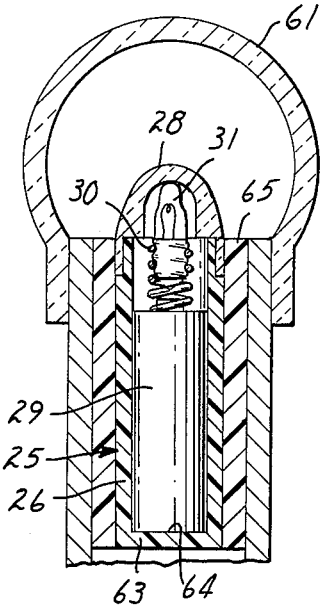
FIG. 9 is a fragmentary vertical sectional view of a baton incorporating the present invention.

In FIG. 9 there is illustrated a baton 60 comprising a cylindrical metallic shaft which is adapted to be twirled in the fingers. On the end of the cylindrical body is an end cap 61 which may be formed of a light-transmitting polymeric material. This end cap may have sufficient resilience to protect the end of the baton and to protect and retain a receptacle 63 which is fitted in the hollow core of the cylindrical body. The receptacle 63 may be formed of a polymeric material and is generally cylindrical with a central bore 64 which will engage the end of the cylindrical body of the baton. Within the bore 64 may be retained a module corresponding to the module 25 shown in FIG. 3. This module, upon the twirling of the baton, will thus produce illumination of the bulbus end 61 on the baton, causing the same to have a light and produce a pleasing aesthetic appearance.

Figure 10:
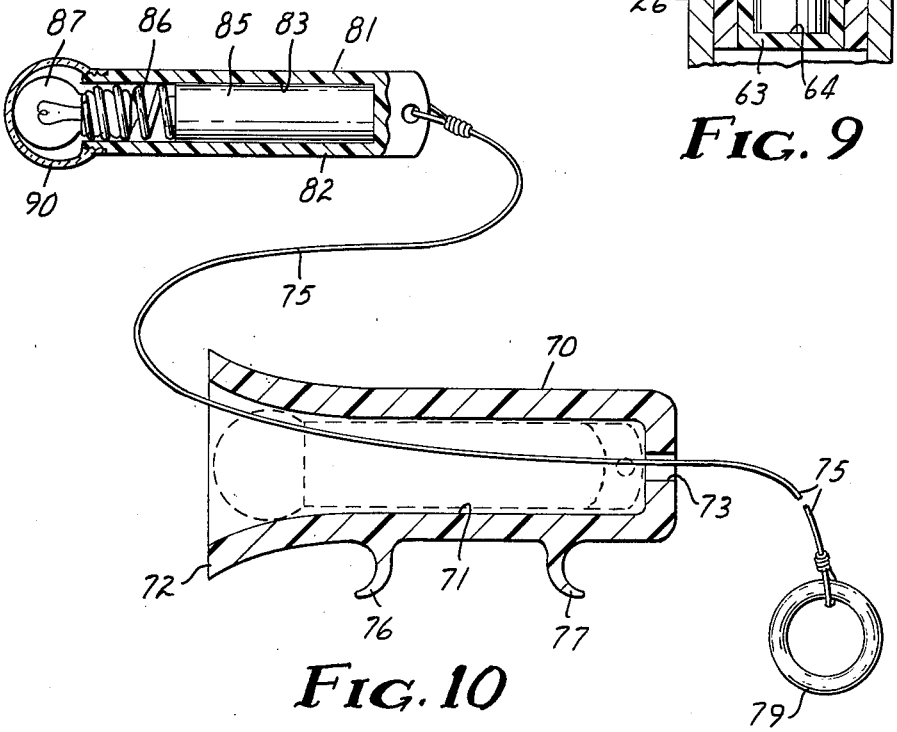
FIG. 10 is a sectional view of a twirl toy according to the present invention and showing a further modification.

In FIG. 10 there is illustrated a twirling toy comprising a handle 70 which is adapted to be held in the hand and which is formed with a generally cylindrical central bore 71. The handle is bell-mouthed at one end 72 to provide a large throat and smooth surface to engage a flexible string or cord 75 which extends through the handle from a small opening 73 at its end opposite the end 72. Depending from one side of the handle 70 is a pair of ears 76 and 77 around which the cord 75 may be wrapped when the toy is not in use.

A loop 79 is secured at one end of the cord 75 to permit insertion of a finger from one hand of the operator. The handle 70 may be held in the opposite hand of the operator. Secured to the opposite end of the cord 75 from the loop 79 is a housing 81 which is shaped and adapted to be received in the handle 70. The housing 81 is provided with a cylindrical shell 82 formed with a central bore 83 to receive the module comprising a battery 85, a helically wound conductive compression spring 86 and an incandescent lamp 87. A transparent or translucent polymeric end cap 90 which may be of a bulbus shape and any desired color or colors maintains the module together in the housing and provides an attractive light when the housing 81 is whirled about the end 72 by the cord 75. The radius of the circle through which the housing is whirled is controlled by the cord pulled through the handle 70. The whirling motion forces the battery 85 against the lamp 87 against the bias of the spring 86.

Having described the present invention with respect to several embodiments thereof it will be understood that other embodiments of toys utilizing the present invention are contemplated. The invention is therefore not limited other than by the appended claims which particularly describe the invention.

What is claimed is:

1. A toy which in operation assumes a circular motion about an axis providing a variation in velocity at points on its body between said axis and an edge, said toy comprising a structure defining the body of said toy and having means defining a receptacle adjacent said edge of said body, and a module received in said receptacle and comprising a housing of insulative material having a first end, a second end and a central cavity extending between said ends, said second end being formed to permit light to pass therethrough and being positioned toward said edge and said first end being positioned between said edge and said axis, a cylindrical battery disposed in said cavity with a center pole piece thereof positioned toward said second end, a helical compression spring of conductive material positioned around and out of contact with said pole piece and contacting the battery end wall, and a small incandescent lamp having a base, a bulb and a terminal end positioned in said cavity, which base is positioned within and engages said compression spring with said terminal end positioned adjacent and aligned with said pole piece, said spring having a normal length sufficient to maintain said terminal end spaced from said pole piece and said spring having sufficient elasticity to permit said battery to move toward said bulb to contact the pole piece with the terminal end of said bulb and energize the same when the battery is subject to centrifugal force, forcing it longitudinally toward said second end.

2. A toy according to claim 1 wherein said housing has retaining means formed thereon compatible with said receptacle for retaining said module to said body.

3. A toy according to claim 1 wherein said body is saucer shaped and said receptacle extends generally radial to said body.

4. A toy according to claim 3 wherein said body has diametrically disposed receptacles with a module disposed in each said receptacle.

5. A toy acording to claim 1, wherein said receptacle is formed with retaining means for releasably retaining said housing in said receptacle.

6. A toy according to claim 1 wherein said second end is formed of transparent material.

7. A toy according to claim 1 wherein said second end is formed with an opening exposing the bulb of said lamp.

8. A toy according to claim 1 wherein said means defining a receptacle comprises a molded body having a cylindrical central portion and two diametrically disposed outwardly extending ribs each having a spoke receiving slot, said central portion having an opening to receive said module.

9. A toy which in operation assumes a circular motion providing a variation in velocity at points on its body, said toy comprising a handle shaped to be held in one hand and having an opening therein defining a large entrance end and terminating with a wall having a small aperture, a cord extending through said aperture, a module secured to one end of the cord and comprising:

a housing of insulative material having a first end secured to said cord, a second translucent end and a central cavity extending between said ends, a cylindrical battery disposed in said cylindrical cavity with the center pole piece thereof positioned toward said second end, a helical compression spring of conductive material positioned around and out of contact with said pole piece and contacting the battery end wall, and a small incandescent lamp having a base, a bulb and a terminal end, which base is positioned within and engages said compression spring with said terminal end positioned adjacent and aligned with said pole piece, said spring having a normal length sufficient to maintain said terminal end spaced from said pole piece and said spring having sufficient elasticity to permit said battery to move toward said bulb to contact the pole piece with the terminal end of said bulb and light the same when the battery is subject to centrifugal force, forcing it toward said second end.

* * * * *